US005205944A

United States Patent [19]

Taylor

[11] Patent Number: 5,205,944

[45] Date of Patent: Apr. 27, 1993

[54] UNIVERSAL CORNERING SYSTEM

[76] Inventor: Cort Taylor, 1828 Main St., Munfordville, Ky. 42765

[21] Appl. No.: 730,345

[22] Filed: Jul. 15, 1991

[51] Int. Cl.[5] ..... E04G 9/08; E04G 11/08

[52] U.S. Cl. ..... 249/194; 249/26; 249/195

[58] Field of Search ..... 249/26, 27, 194, 195, 249/184, 185, 186, 18, 189, 48, 210, 184, 178

[56] References Cited

U.S. PATENT DOCUMENTS

| | | | |
|---|---|---|---|
| 1,120,569 | 8/1912 | Van Horn | 249/194 |
| 1,206,598 | 11/1916 | Sager | 249/27 |
| 1,394,790 | 6/1920 | Roughsedge | 249/194 |
| 1,599,035 | 9/1926 | Baumberger | 249/194 |
| 2,794,235 | 6/1957 | Hillberg | 249/194 |
| 2,849,780 | 9/1958 | Hillberg | 249/194 |
| 3,131,453 | 5/1964 | Stockton et al. | 249/194 |

FOREIGN PATENT DOCUMENTS

| | | | |
|---|---|---|---|
| 938987 | 7/1949 | Fed. Rep. of Germany | 249/194 |
| 3211882 | 10/1983 | Fed. Rep. of Germany | 249/194 |

*Primary Examiner*—Jay H. Woo
*Assistant Examiner*—Khanh P. Nguyen

[57] ABSTRACT

The present invention includes a concrete corner forming device of solid metal construction for forming a 45° angle, 90° angle, off set angle, and the hinge type angle that forms other various degree angles. The hinge type corner can adapt to most any angle by utilizing the hinge designed into it. This invention is of knockdown construction for ease in transportation to a work site.

10 Claims, 8 Drawing Sheets

FIG.1
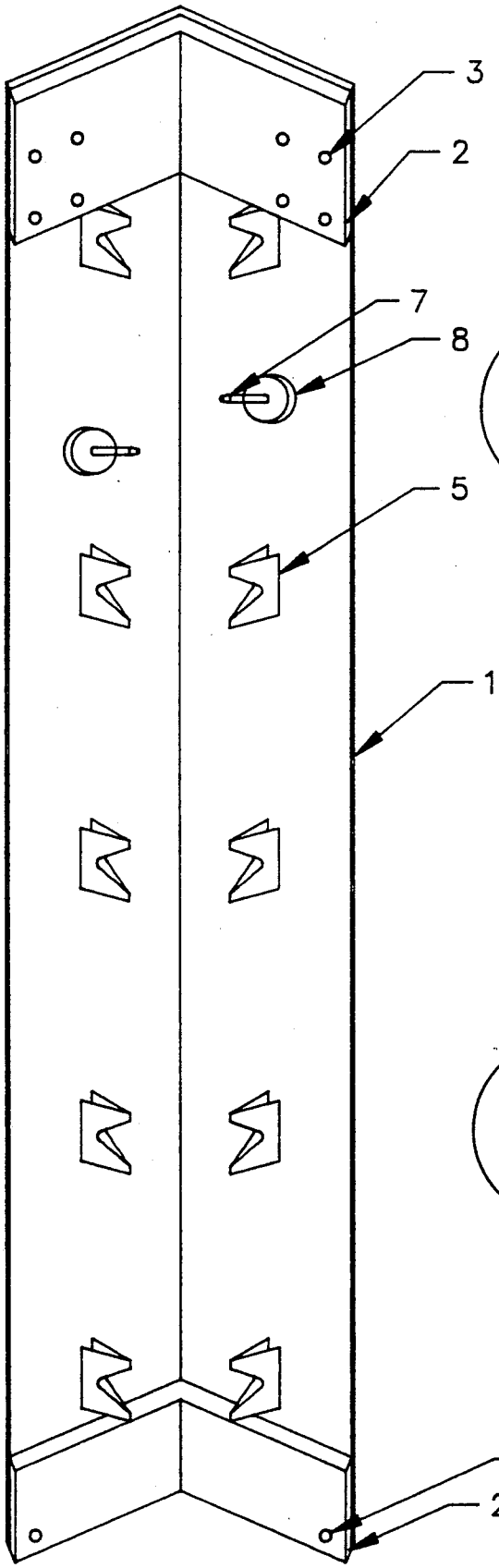
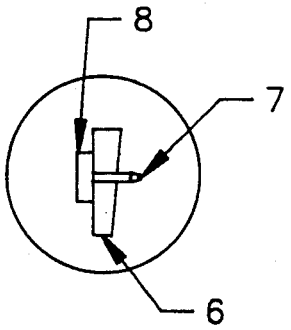
FIG.1A
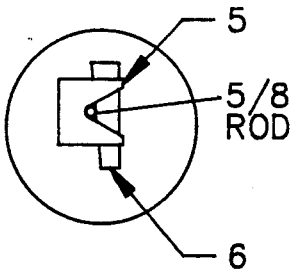
FIG.1B

FIG.5
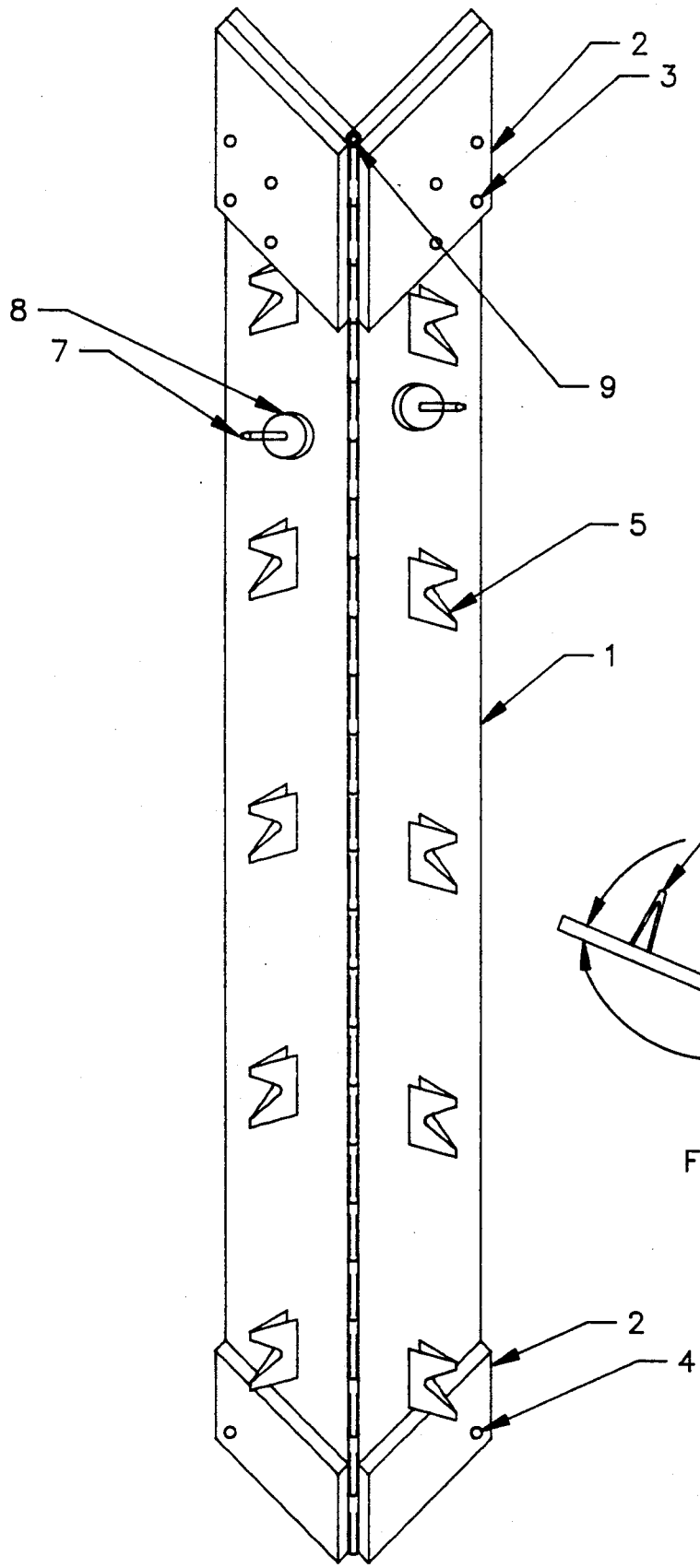
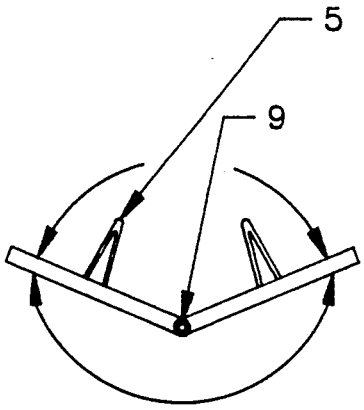
FIG.5A

FIG.6
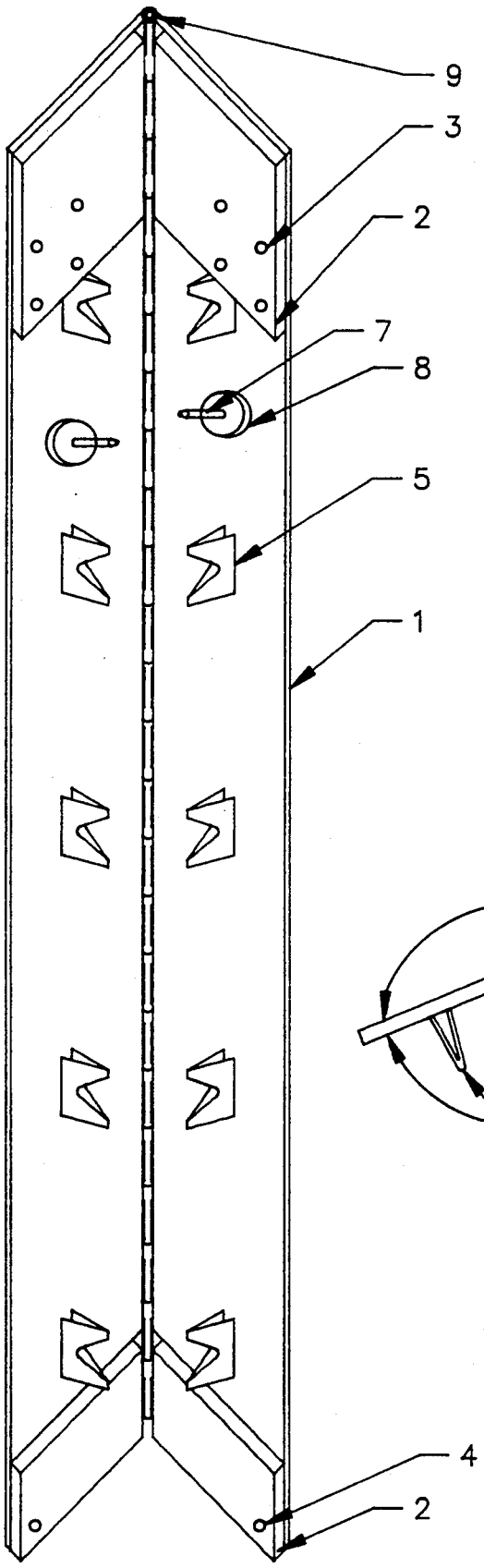
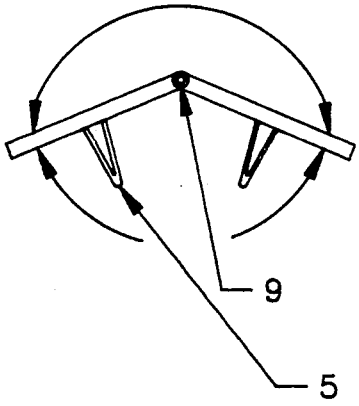
FIG.6A

UNIVERSAL CORNERING SYSTEM

BACKGROUND OF THE INVENTION

1. Field of the Invention

This invention relates in general to the construction of concrete corner forming devices and in particular to concrete corner forming devices wherein the construction of this invention uses a one-piece unit for producing corners instead of the current multi-piece construction.

2. Prior Art

In the past, construction of concrete corners were accomplished by using two pieces of wood with several loop devices attached to the wood. These two pieces are then forced together by the insertion of a steel rod through the loop devices. Such a corner should be easily set up and produce a smooth and accurate corner. Normally, such a corner would be constructed by using multi-piece materials. This type construction is well known in this art. However, the concrete corners described in the prior art do not provide a smoother, more accurate, and more versatile corner that is amendable to a range of various angles such as the 45°, 90°, off-set, and the hinge type. The latter will accommodate most any other degree angle necessary in the construction of concrete corners.

SUMMARY OF THE INVENTION

The principle object of the present invention is to provide a corner forming device incorporating the rod type forming system for use in creating a nearly perfect corner consisting of 3×3 solid metal material so as not to allow any leak or buldge in the corner.

A further object is to provide such a device which, in proper use, will practically eliminate the fear of losing concrete because the cornering device is of solid metal construction as well as the rod locks which support the corner.

It also is an object of the present invention to provide a device which is of simple, inexpensive one-piece construction.

Another object is to provide such a device in lightweight form that can be disassembled and reassembled quickly and easily for transportation to another job site, such as in the back of a pickup.

A further object is to provide a device that cannot wear out or be torn up under normal use since the corner is of solid metal construction.

This device, when incorporated into the rod type forming system, hereby makes the system so universal that they can be used to form any number of corners with ease. The system, in addition, can form any length wall from inches to feet without cutting up the plyform.

The foregoing objects can be accomplished by providing a concrete corner forming device comprised of a single piece of angled metal that has shim plates on the top and bottom sections. These metal shim plates are welded in place. Locks are positioned vertically and are welded to the one-piece corner unit. Turnbuckle pins are positioned at the upper section of the corner device and also welded into place. The 45° and 90° angled corners result from this design. The hinge type corner unit is the same as described above with the exception of the piano hinges used to manipulate the device into various degree angles. The off set corner may be described as the before mentioned corners but, this metal corner is angled into plural sections which are neither separate nor hinged. An extra turnbuckle is the only piece added to the center section.

FIG. 1 (A and B) is a perspective view showing a 45° inside corner.

FIG. 5 is a perspective view showing a 90° inside corner.

FIG. 6 is a perspective view showing a 90° outside corner.

FIG. 9 is a perspective view showing a hinged inside corner.

FIG. 10 is a fragmentary perspective view of a hinged inside corner whereby allowing FIG. 9 to be manipulated into various degree angles.

FIG. 11 is a perspective view showing an off set inside corner.

FIG. 12 is a perspective view showing an off set outside corner.

DETAILED DESCRIPTION

Figure 2:
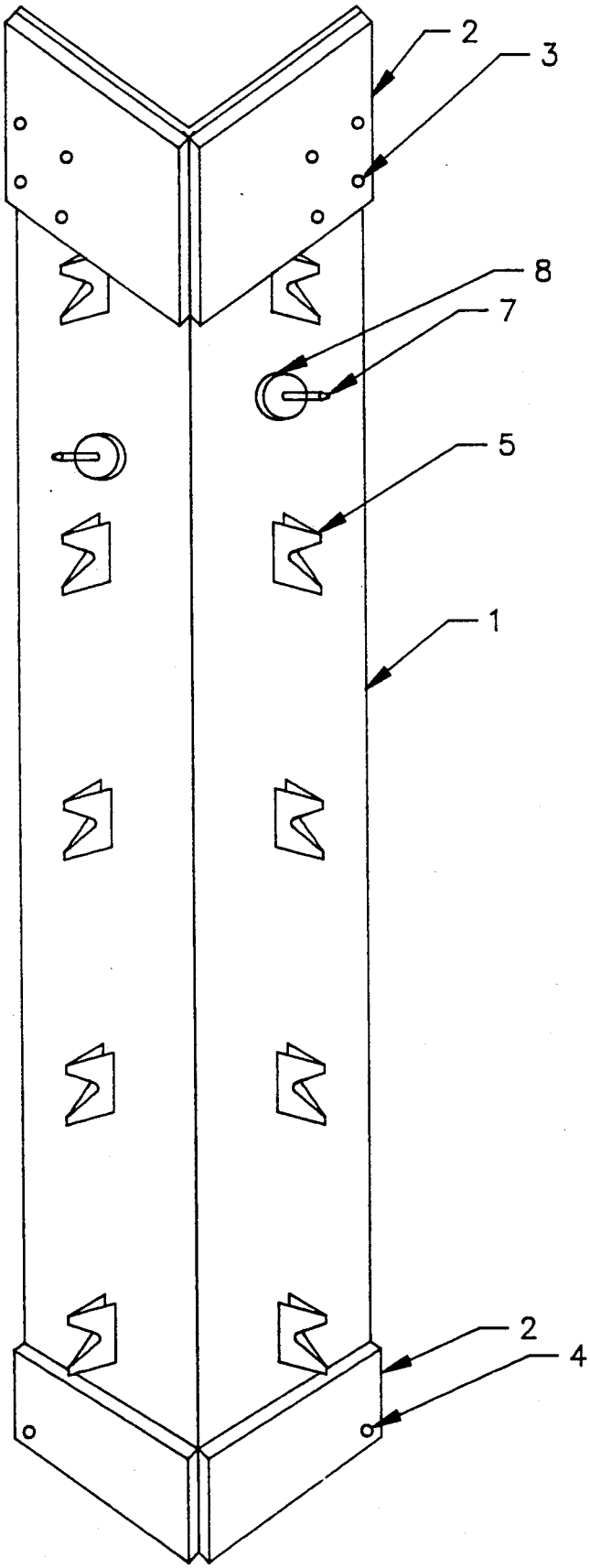
FIG. 2 is a fragmentary perspective view showing inside/outside corner locking device to secure turnbuckle to the corner.
Figure 3:
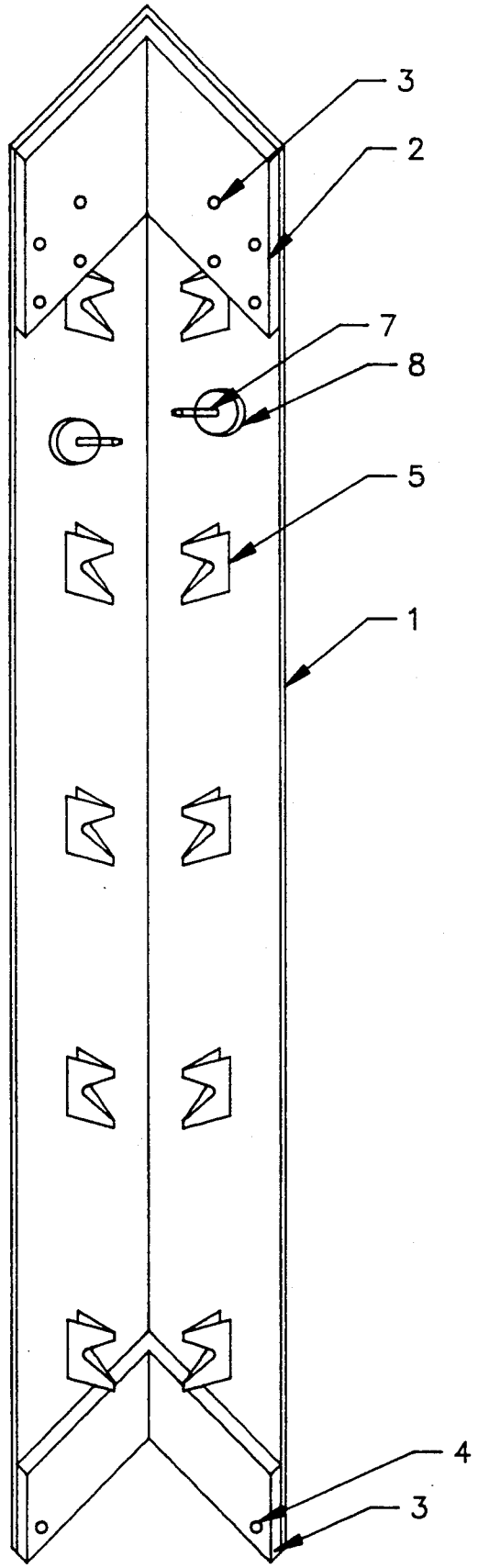
FIG. 3 is fragmentary perspective views showing inside/outside corner locking device to secure corner to rod type forming system.
Figures 4, 4A, 4B:
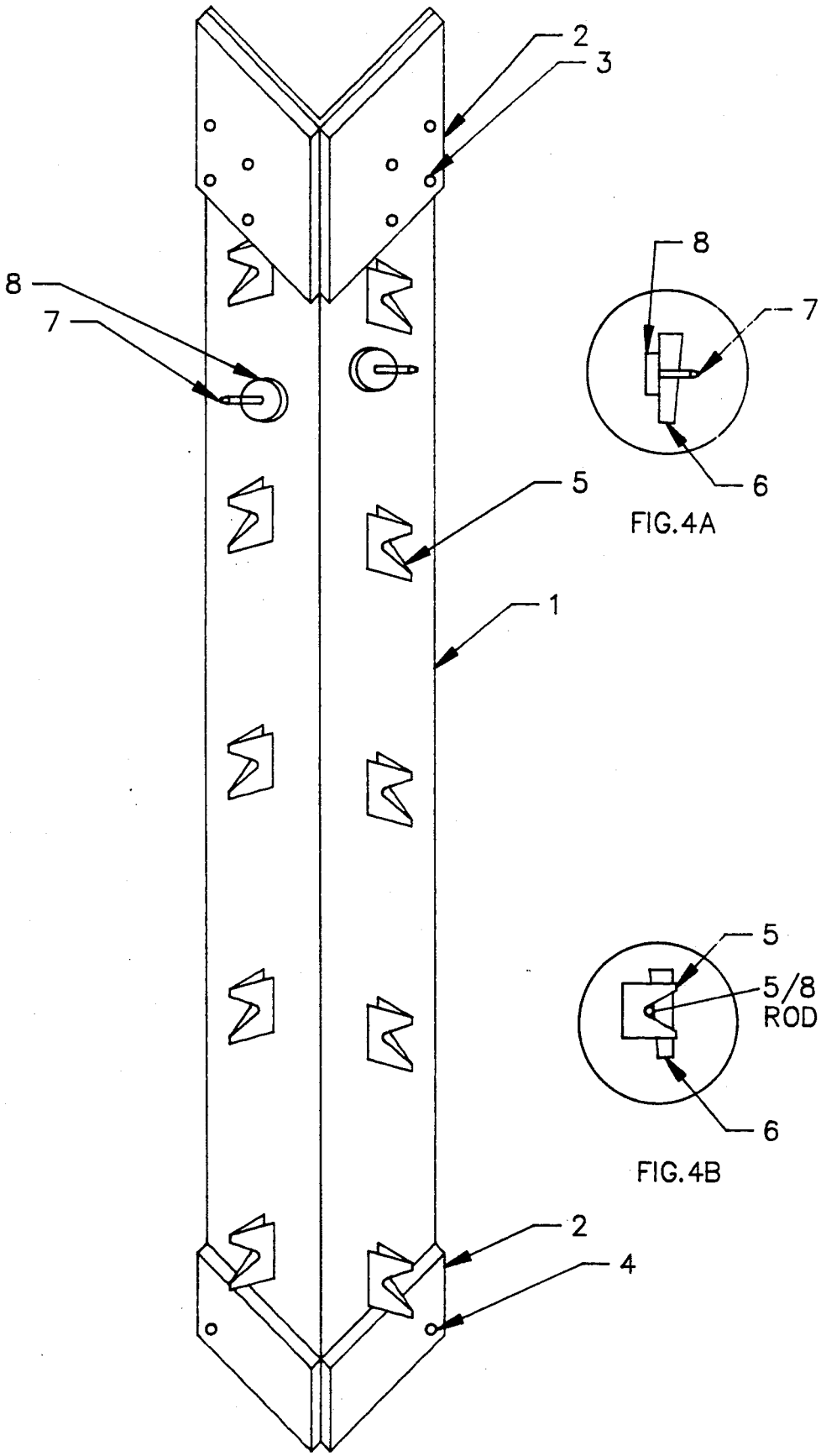
FIG. 4 is a perspective view showing a 45° outside corner.
Figure 7:
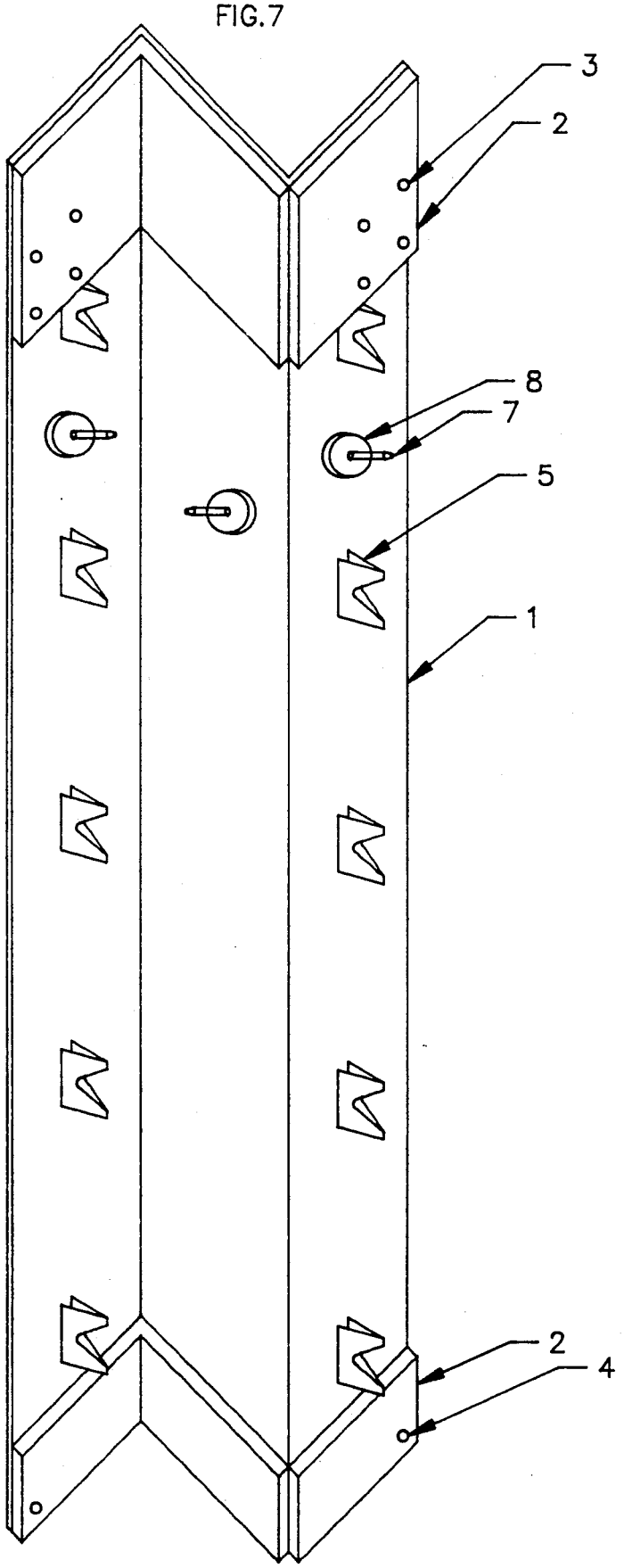
FIG. 7 is a perspective view showing a hinged outside corner.
Figure 8:
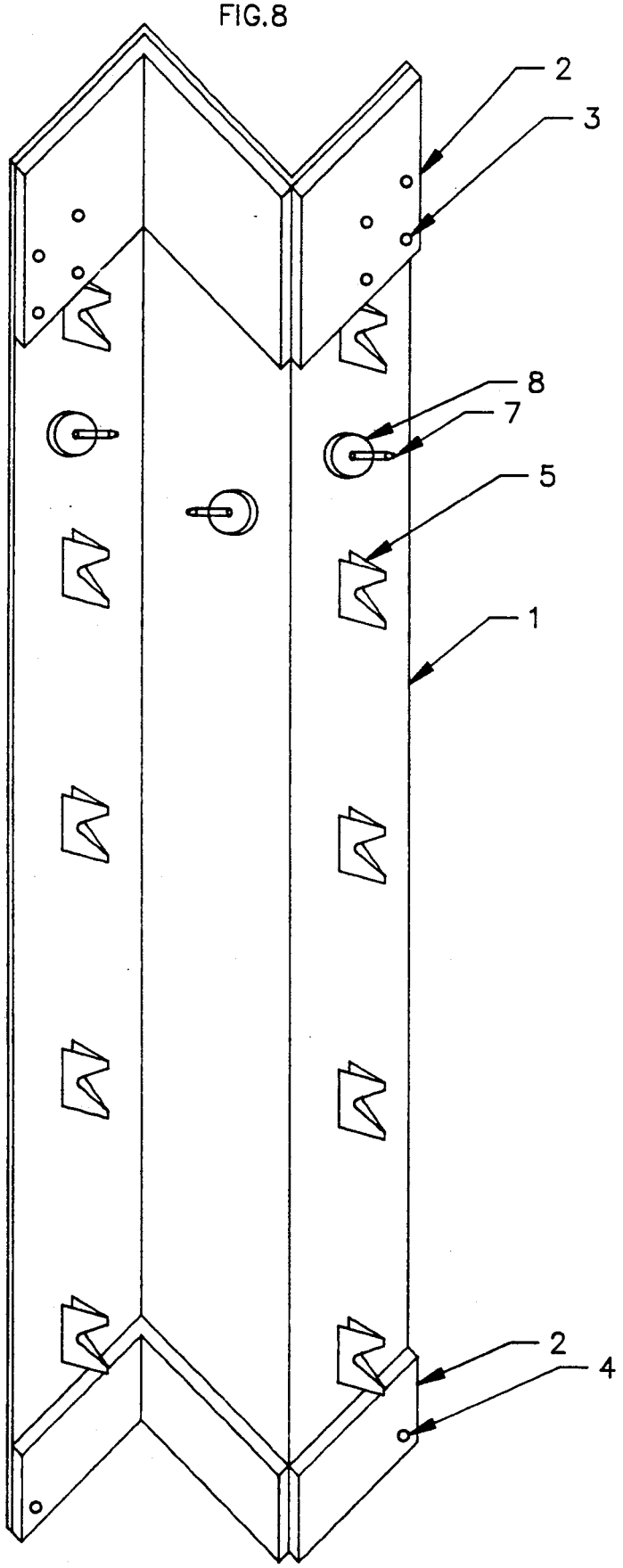
FIG. 8 is a fragmentary perspective view of a hinged outside corner whereby allowing FIG. 7 to be manipulated into various degree angles.

As shown in the 45° and 90° drawings, the preferred cornering device in accordance with the present invention includes a single piece of 3 by 3 by ¼ inches by 8 foot angle metal corner device 1 with 3 by 3 by ½ inch shim plates 2 welded to the top and bottom sections to align the device flush with the rod type forming system by using four nails in each existing nail hole 3 in the top plate and one in each bottom plate 4 to hold the 2 by 4 waler to the forms and corner.

Five locks 5 are welded to the corner device on each of the sides and are in line with the rod that holds the forms and corner in a locked position. There is no movement after the wedge pins 6 are installed, locking the rods to the corner. There are two ⅝ by 2 inch slotted pins 7, one on each side, near the top of the corner device. Both are welded to the metal corner device so that a turnbuckle can be installed and vertically align the corner unit.

The turnbuckle is then locked with a wedge pin 6. A ½ or ⅝ inch oil resistant rubber bushing 8, located between the turnbuckle and the corner, is used to compress and absorb all vibration. The inside and outside corners are, of course, identical in construction.

The hinge type corner is of the same construction as the 45° and 90° corner with the exception of the piano hinge 9 used in the design so as to allow various angles of construction.

The 4 inch off set corner is of the same construction as the 45° and 90° corner with the exception of an extra turnbuckle located centrally inside the tri-cornered off set unit. The shim plate dimensions are 3 by 3 by ½ inches connected to a 4 by 3 by ½ inch shim that is connected to a 3 by 3 by ½ inch shim plate to form the off set corner.

What is claimed is:

1. A concrete corner forming device adapted for using with a rod type forming system having a rod and form panels, said corner forming device comprising:

an angle metal form having first and second forming members defining a desired angle, each of said forming member having a forming surface adapted to contact with a molding concrete material and an opposing back surface;

a plurality of metal shim plates welded to the back surface of top and bottom portions of each of the forming members;

a plurality of nail holes formed in the bottom and top shim plates of each of said forming members whereby the angle metal form is flush with the form panels located adjacent to the first and second forming members by waler members which are mounted to the top and bottom shim plates of said forming members by nails extending through said nail holes; and a plurality of locking elements welded to the back surface of each of said forming members and being vertically spaced-apart from the top shim plate to the bottom shim plate whereby said locking element receives the rod of the rod type forming system for holding the corner forming device and the form panels in a locked position.

2. The concrete corner forming device according to claim 1 and further comprising a plurality of slotted pins provided near the top shim plate of the each of the forming members, each pin having a slot.

3. The concrete of corner forming device according to claim 2 and further comprising a wedge pin received by said slot of said slotted pin.

4. The concrete corner forming device according to a claim 3 and further comprising a rubber bushing located between the back surface of each of the forming member and the wedge pin for absorbing vibrations.

5. The concrete corner forming device according to claim 1 and wherein said forming members define an acute angle.

6. The concrete corner forming device according to claim 1 and wherein said forming members define an obtuse angle.

7. The concrete corner forming device according to claim 1 and further comprising means for adjusting said angle.

8. The corner forming device according to claim 7 and wherein said means for adjusting said angle is a hinge connecting the first forming member to the second forming member.

9. The corner forming device according to claim 1 and wherein the angle metal form includes a third forming member located between the first and second forming members and connecting said first and second forming member to define a tri-cornered off set unit.

10. The corner forming member according to claim 9 and wherein a plurality of shim plates are welded to top and bottom portions of a back surface of said third forming member.

* * * * *